US008679277B2

(12) United States Patent
Reese et al.

(10) Patent No.: US 8,679,277 B2
(45) Date of Patent: Mar. 25, 2014

(54) NAPKIN APPARATUS AND METHOD

(76) Inventors: Dennis F. Reese, Medina, OH (US); Mitchell V. Holden, Strongsville, OH (US)

( * ) Notice: Subject to any disclaimer, the term of this patent is extended or adjusted under 35 U.S.C. 154(b) by 0 days.

(21) Appl. No.: 13/460,113

(22) Filed: Apr. 30, 2012

(65) Prior Publication Data

US 2012/0279644 A1 Nov. 8, 2012

Related U.S. Application Data

(60) Provisional application No. 61/481,465, filed on May 2, 2011.

(51) Int. Cl.

| | |
|---|---|
| ***B29C 65/54*** | (2006.01) |
| ***B32B 37/12*** | (2006.01) |
| ***B32B 37/26*** | (2006.01) |
| ***B32B 38/14*** | (2006.01) |
| ***B32B 43/00*** | (2006.01) |
| ***A45F 5/04*** | (2006.01) |

(52) U.S. Cl.
USPC ..... 156/239; 156/249; 156/277; 24/7

(58) Field of Classification Search
USPC ..... 156/230, 234, 235, 247, 249, 277, 281; 24/7, 67 R, 7.67 R, 67 AR
See application file for complete search history.

(56) References Cited

U.S. PATENT DOCUMENTS

| | | | | |
|---|---|---|---|---|
| 3,143,208 | A * | 8/1964 | Sizemore, Jr. | 428/43 |
| 3,675,274 | A * | 7/1972 | Fried et al. | 24/67 R |
| 5,187,813 | A * | 2/1993 | Klein | 2/16 |
| 5,476,697 | A * | 12/1995 | Bellander | 428/41.9 |
| 5,641,567 | A * | 6/1997 | Brown et al. | 428/327 |
| 6,331,018 | B1 * | 12/2001 | Roth et al. | 283/81 |
| 6,828,018 | B2 * | 12/2004 | Waterbury et al. | 428/354 |
| 2006/0084935 | A1 * | 4/2006 | Junqueira Franco et al. | 604/368 |
| 2007/0185469 | A1 * | 8/2007 | Green | 604/387 |
| 2007/0190280 | A1 * | 8/2007 | Harada et al. | 428/40.1 |
| 2012/0189827 | A1 * | 7/2012 | Shaw | 428/195.1 |

* cited by examiner

*Primary Examiner* — Sing P Chan
(74) *Attorney, Agent, or Firm* — Christopher L. Parmelee; Walker & Jocke

(57) ABSTRACT

A method is provided that includes peeling at least one carrier strip away from an adhesive layer of an adhesive article. The adhesive article includes a flexible substrate with the adhesive layer thereon, wherein the adhesive layer remains mounted to the flexible substrate of the adhesive article after the carrier strip is peeled away, wherein the adhesive article is operative to disintegrate when submerged in water. The method also includes using the adhesive article to adhesively mount a cloth or paper napkin to clothing being worn by a person. The carrier strip or adhesive article may include advertising and/or a coupon printed thereon, which may be taken away by the person after the meal.

7 Claims, 7 Drawing Sheets

NAPKIN APPARATUS AND METHOD

BACKGROUND

In many restaurants, napkins are provided to patrons for use during their meals. Some restaurants provide paper napkins while other restaurants provide cloth napkins. While paper napkins are thrown away after use, cloth napkins are typically washed in a washing machine and reused by the restaurant.

During a meal, a napkin may be used to remove food from a person's face and hands. However, napkins may also be used as a barrier to protect clothing from splashed and spilled food and liquids. For example, a napkin may be placed on a person's lap or may be tucked into a person's shirt in order to shield portions of the person's clothes.

Napkins typically have a square or rectangular shape. However, it should be appreciated that Napkins may have other contours (e.g., ovals, circles, or other shapes). In addition, napkins may have different sizes, with lengths and widths ranging from less than a foot to more than two feet. As an example, a cloth napkin used by some restaurants may have dimensions of 15×15 inches, while other restaurants may use smaller or larger napkins. However, regardless of the shape and size of the napkin, spilled/splashed food or drink may still find a path to contact and/or stain a person's clothing. Thus napkins may benefit from improvements.

SUMMARY

The following is a brief summary of subject matter that is described in greater detail herein. This summary is not intended to be limiting as to the scope of the claims.

In an example embodiment, an apparatus is provided that facilitates mounting a napkin (which may be a cloth napkin or a paper napkin) in a manner that increases the surface area of a person's clothing that is covered by and thus protected by the napkin. As used herein, a cloth napkin corresponds to a sheet of woven fabric. Cloth napkins may be comprised of woven cotton. However, it should be appreciated that cloth napkins may be woven from fibers/yarns of other types of materials (e.g., polyester, linen, and silk) and/or combinations of different types of materials (e.g., cotton and polyester).

In an example, the apparatus may be comprised of an adhesive article having a water dissolvable pressure sensitive adhesive layer adjacent at least one face of a flexible substrate. When manual pressure is applied, the adhesive layer is capable of adhesively adhering the adhesive article to both a cloth napkin and a person's clothing (e.g., a shirt, dress, coat, or other garment) in a manner to maintain the cloth napkin in adhesive connection with the person's clothing. Also, it should be appreciated that in the examples described herein, the adhesive article may be used to place a paper napkin in adhesive connection with the person's clothing as well.

In an example embodiment, the flexible substrate of the adhesive article may be capable of being printed thereon to support printed indicia representative of words, text, and images in a form of an advertisement, coupon, instructions, marketing material, artwork, and/or any other information that may be taken away for later use by the patron. The apparatus may also include a carrier strip to which the adhesive article is removably mounted. Such a carrier strip may also include printed indicia thereon (on one or both faces) that is representative of words, text, and images in a form of an advertisement, coupon, instructions, marketing material, artwork, and/or any other information that may be taken away for later use by the patron.

In this described embodiment, the adhesive article (including both the adhesive layer and the flexible substrate) may be adapted to disintegrate in the presence of water (and/or steam) in less than 30 seconds with agitation (i.e., causing turbulence and/or roiling) of the water (such as the agitation/turbulence/roiling associated with a clothes washing machine). Thus if the adhesive article were left on the person's clothing or on a cloth napkin when the clothing or cloth napkin were washed in a clothes washing machine, the adhesive article is operative to disintegrate in the wash in a manner that prevents the adhesive article from clogging drain lines and/or other portions of washing/drying machines.

An example method of using the apparatus may include peeling the adhesive article away from the carrier strip. The side of the adhesive article including the adhesive layer may then be placed along an edge of the napkin with at least a portion of the adhesive article extending outwardly from the napkin. The portion of the adhesive article that extends outwardly from the napkin may then be placed adjacent a portion of user's clothing (e.g., a shirt) such that the outwardly ending portion is adhesively mounted to the clothing with the napkin draped downwardly covering at least a portion of the person's clothing. In this example, the carrier strip and/or the adhesive article may include a coupon printed thereon, to which the user may wish to save for subsequent use at the present restaurant or another business.

Also, it should be appreciated that the described apparatus may have other forms that are operative to mount a napkin to a person's clothing and still disintegrate in the presence of water. For example, in a further embodiment, the apparatus may include pressure-sensitive adhesive layers on opposed faces of a flexible substrate. Carrier strips may be mounted on each face as well. In this example, the person may peel away a first carrier strip and mount the adhesive article with the exposed first side adhesive layer to the napkin. Subsequently, the person can remove the second carrier strip from the adhesive article and may place the napkin adjacent the person's clothing such that the exposed second side adhesive layer is adjacent the person's clothing, with the napkin dangling downwardly therefrom, and the adhesive article hidden from view.

Other aspects will be appreciated upon reading and understanding the attached figures and description.

DETAILED DESCRIPTION

Figure 1:
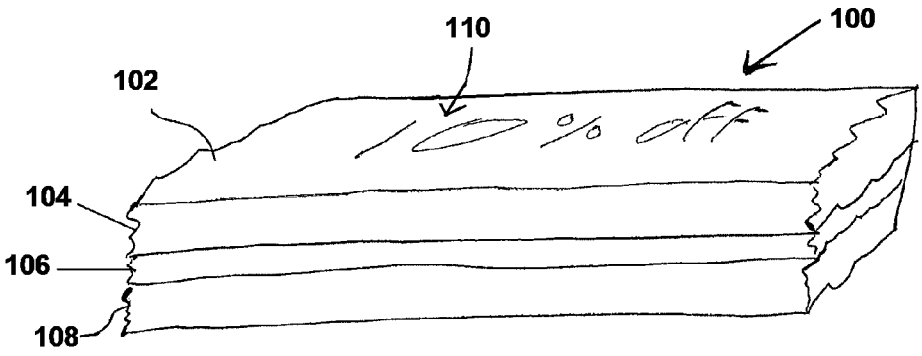
FIG. 1 illustrates an example of an apparatus that is usable to mount a napkin to a person's clothing.

Various technologies pertaining to mounting napkins to clothing of a person will now be described with reference to the drawings, where like reference numerals represent like elements throughout. In addition, several functional block diagrams of example systems are illustrated and described herein for purposes of explanation; however, it is to be understood that functionality that is described as being carried out by certain components may be performed by multiple components. Similarly, for instance, a component may be configured to perform functionality that is described as being carried out by multiple components.

With reference to FIG. 1, an example apparatus 100 that facilitates mounting a napkin to a person's clothing is illustrated. The apparatus 100 includes an adhesive article 102 including a flexible substrate 104 (which may be in a shape of an elongated strip). The adhesive article may also include at least one adhesive layer 106 applied to at least one face (i.e., side) of the flexible substrate 104 of the adhesive article 102. To minimize damage to the adhesive layer 106 (prior to use of the adhesive article), the apparatus may include a carrier strip 108 (e.g., a release sheet) in removable connection with the adhesive layer 106 of the adhesive article 102. In this described embodiment, the carrier strip may be in removable connection with the carrier strip, such that the adhesive article can be manually removed from the carrier strip without delaminating the adhesive layer 106 from the flexible substrate 104. Also, as shown in FIG. 1, either or both of the carrier strip 108 and adhesive article 102 may include printed indicia 110 thereon. Such printed indicia may correspond to an advertisement, coupon, instructions for mounting the article, or any other information. As used herein, indicia depicting a coupon conveys a discount with respect to at least one of an item and a service.

The adhesive article (e.g., both the flexible substrate and adhesive layer) may be comprised of materials that are operative to disintegrate when placed in water in a time frame of less than 30 seconds at a temperate of 70° F. with agitation of the water. Examples of disintegrateable materials that may be used to produce the described adhesive article are shown in U.S. Pat. No. 6,828,018. For example, the adhesive layer may be comprised of a water dissolvable pressure sensitive adhesive and the flexible substrate may be comprised of a water dissolvable paper. For example, in one example of the described apparatus, the adhesive article was produced from dissolvable paper sold under the brand of Dissolvo by Daymark Technologies in Bowling Green, Ohio. However, it should be appreciated that the described adhesive article may be comprised of other types of materials which are capable of removably mounting a napkin to clothing (while supporting the weight of the napkin), which are also capable of disintegrating in water during a washing cycle in a commercial cloths washing machine, and which may be capable of having indicia printed thereon.

As used herein, disintegration of the adhesive article corresponds to the breaking up and/or the dissolving in water of the adhesive article, such that all (or at least substantially all, such as more than 95%) of the solid residue (from the adhesive article) remaining in the water is separated into unconnected flakes with a size of less than ¼ of an inch.

Figure 2:
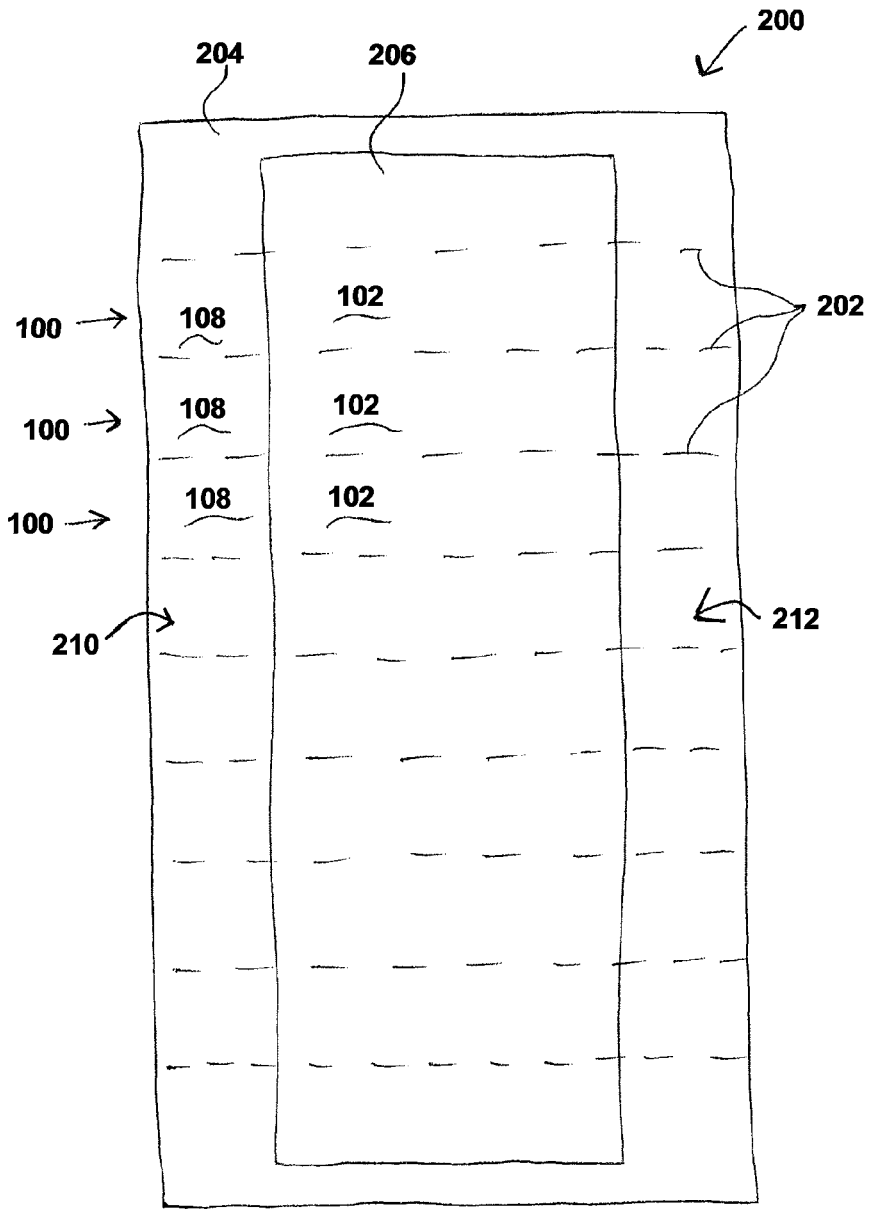
FIG. 2 illustrates an example apparatus in the form of a sheet having a plurality of adhesive articles connected via perforations.

Referring now to FIG. 2, an example sheet 200 for packaging the previously described apparatus 100 is shown. In this example, the packaging sheet 200 includes a plurality of the previously described apparatuses 100 (i.e., adhesive articles and carrier strips) with perforations 202 between adjacent articles. The packing sheet 200 may include a carrier sheet 204 having an adhesive sheet 206 removably adhered thereto, which adhesive sheet 206 is comprised of the previously described material and adhesive which disintegrate in water.

The example packaging sheet 200 may be cut (e.g., die cut) to include the plurality of spaced-apart perforations 202 (through both the carrier sheet 204 and the adhesive sheet 206). The packaging sheet 200 may be torn apart at each of the perforations to produce a plurality of the apparatuses 100. In example embodiments, the perforations may be cut every 1.25 inches along the packaging sheet 200, thus when the packaging sheet is torn apart, several of the apparatuses 100 may have heights of 1.25 inches.

In an example embodiment, the carrier sheet 204 may have a size of a conventional paper (e.g., 8.5×11 inches) or other standardized size of paper (A4 paper). In other example embodiments, the carrier sheet 204 may have other sizes (e.g. 7.5×12.75 inches), or some other size. In addition as illustrated in FIG. 2, the adhesive sheet 206 may have a width that is less than a width of the carrier sheet 204. For example on a carrier sheet that is 7.5 inches wide, an example embodiment may include an adhesive sheet 206 that is 7 inches wide. As a result, the carrier sheet may include one end or may include opposed ends 210, 212 that are not covered by the adhesive sheet 206. When the apparatuses 100 are separated from the larger packaging sheet 200, each will have corresponding opposed ends of the carrier strip 108 that are not covered by the article 102. Such ends of the carrier strips may serve as small tabs to assist in removing the adhesive article 102 from the carrier strip.

In this described example, the adhesive article may have a size of about 7 inches by 1.25 inches and may be mounted to a carrier strip that is 7.5 inches by 1.25 inches. However, it should be appreciated that this is only one example. Other example embodiments may have other dimensions depending on the desired size of the adhesive article and/or the amount of surface area of the adhesive layer that is needed to maintain a napkin in adhesive connection to the clothing of a person.

Figure 3:
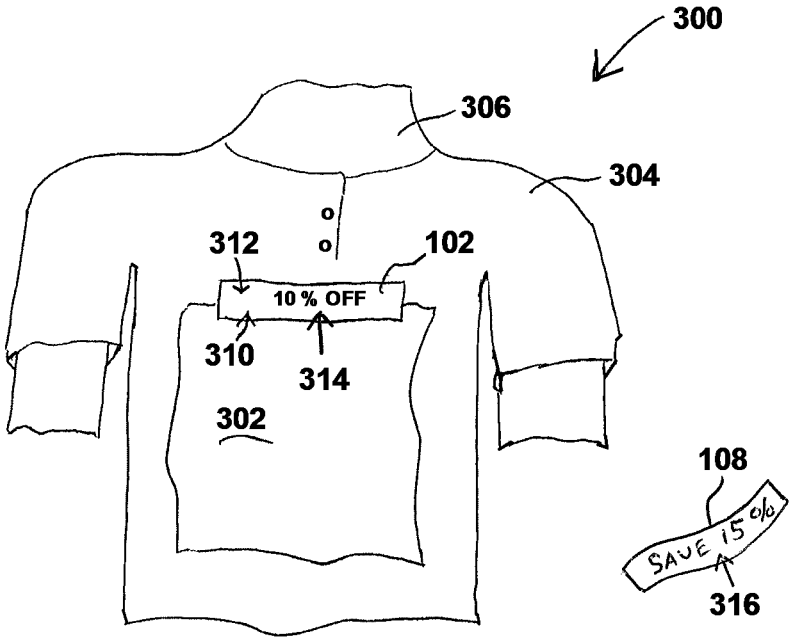
FIG. 3 illustrates an example of a napkin mounted to clothing via an example adhesive article.

FIG. 3 illustrates an example 300 in which an adhesive article 102 is used to mount a napkin 302 to clothing 304 (e.g., a shirt) of a person 306. As shown in FIG. 3, the adhesive article 102 may be mounted such that a lower portion 310 of the adhesive article 102 is adhesively mounted (via the adhesive layer of the adhesive article) to the upper edge of the napkin 302. An upper portion 312 of the adhesive article 102 may then be adhesively mounted (via the adhesive layer of the adhesive article) to the clothing 304 of the person 306.

In this described embodiment, an example methodology for using the described adhesive article may include a step of peeling the adhesive article 102 away from its carrier strip. This methodology may also include a step of placing the lower portion 310 of the article into adhesive connection (via application of manual pressure) with an upper edge of the napkin 302, such that the upper portion 312 of the adhesive article extends outwardly from the top edge of the napkin. The methodology may further include moving the napkin and article adjacent to the clothing 304 of the person and placing the outwardly extending upper portion 312 of the adhesive article into adhesive connection (via manual pressure) with the clothing 304, such that the napkin is supported by the adhesive article on the shirt and dangles downwardly therefrom.

In this described embodiment, the adhesive article may have been previously torn from the packaging sheet 200 shown in FIG. 2. Thus the adhesive article may include perforated upper and/or lower edges. In addition, it should be appreciated that one or more sides of the adhesive article and/or the carrier strip may include printed indicia 314, 316 thereon such as a coupon or advertisement. Thus, the person using the described apparatus 100 may keep the removed carrier strip (with a coupon printed on a back side thereof). Also, in embodiments where the adhesive article 102 includes printed indicia, the person may remove the adhesive article from the napkin after completing a meal in order to save the coupon.

Figure 4:
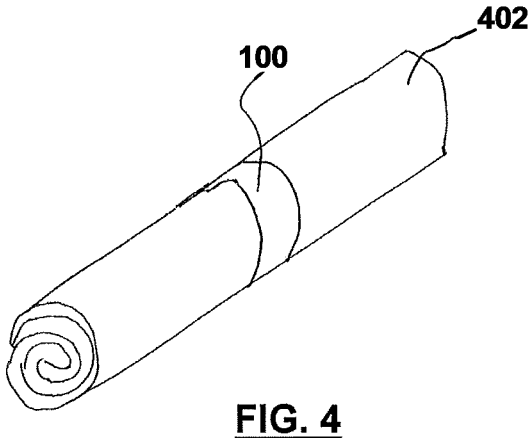
FIG. 4 illustrates an example of a rolled up napkin bound via a ring formed from an example apparatus.

In addition, it should be appreciated that the adhesive article may be used in other example methodologies. For example, as shown in FIG. 4, a further methodology may include a step of folding or rolling a napkin 402 into an elongated roll (which may or may not include one or more eating utensils therein). The methodology may also include a step of curving the previously described apparatus 100 into a ring and a step of attaching the opposed ends of the apparatus 100 together, such that the formed ring is operative to hold the roll from becoming unwound and/or unfolded.

Figure 5:
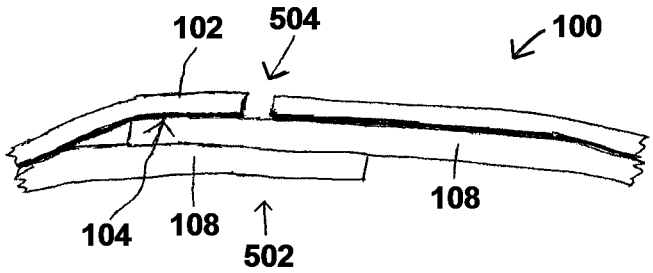
FIG. 5 illustrates an example manner of attaching ends of an example apparatus together to form a ring.

In this described methodology, the ends of the apparatus 100 may be attached together as shown in FIG. 5. In this example, the attaching step may include a step of peeling back a portion of the adhesive article 102 from the carrier strip 108 on one end 502 of the apparatus 100. The attaching step may also include a step of inserting the opposed second end 504 of the apparatus 100 between the separated adhesive article 102 and carrier strip 108. In addition, the fastening step may include manually pressing the second end 504 of the apparatus against the exposed adhesive layer 104 of the peeled-away portion of the adhesive article 102 in order to hold the opposed ends 502, 504 together.

Also, it should be appreciated that in examples where the described apparatus is provided in one or more of the packaging sheets 200 shown in FIG. 2, the example methodologies may include a step in which one or more apparatuses 100 are separated from the packaging sheet 200 by tearing the sheet along the perforations 202. Such a step of separating the apparatuses 100 from the packaging sheet 200 and/or forming rings around napkins using the apparatuses 100 may be carried out by employees of a restaurant. When a table is being set, the restaurant employees may place napkins bounded via the described apparatuses at each place setting. The patrons of the restaurant may then disconnect the a ring around a napkin by peeling the second end 504 of an apparatus 100 away from the adhesive layer 104 of the first end of the apparatus 502. The patrons may then use the apparatus as described previously to mount the napkin to their clothing.

Figure 6:
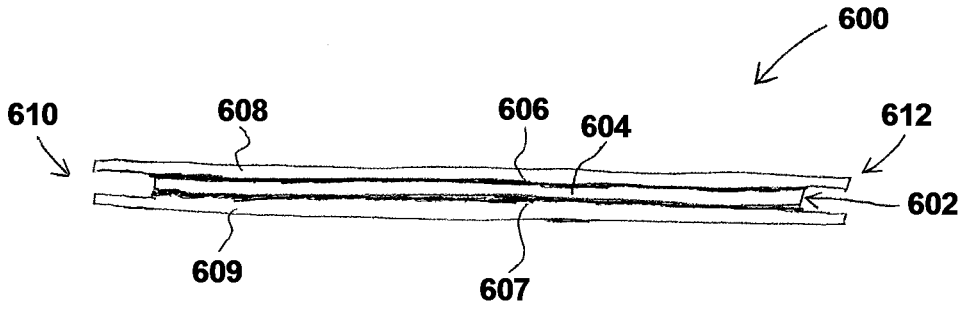
FIG. 6 illustrates a further example embodiment of an apparatus that includes an adhesive article having water dissolvable pressure sensitive adhesive layers on opposed sides of a flexible substrate.

In the previously described examples, the apparatus 100 has been described as having an adhesive article with one side of a flexible substrate that includes an adhesive layer. However, it should be appreciated that example embodiments may include an adhesive layer on each side of the flexible substrate. An example embodiment of such an apparatus 600 is shown in FIG. 6. Here the apparatus 600 includes an adhesive article 602 comprised of a flexible substrate 604 with adhesive layers 606, 607 applied to the opposed sides of the flexible substrate 604. In addition, the apparatus may include carrier strips 608, 609 in removable connection with the adhesive layers.

As shown in FIG. 6, the carrier strips may have widths that are greater than the width of the article 602. As a result, outwardly extending ends 610, 612 may serve as tabs to enable the carrier strips to be manually removed from the article 602 more easily.

In this described embodiment, one or both of the carrier strips 608, 609 may include printed indicia thereon such as coupons, advertisements, and/or instructions for using the apparatus 600. In addition, it should be appreciated that the flexible substrate 604 and adhesive layers 606, 607 are comprised of materials that disintegrate when placed in water (e.g., such as being made out of dissolvable paper made by Dissolvo). Also, this described embodiment of the apparatus 600 may be rolled into a ring for binding a napkin as previously shown with respect to FIG. 4. The ends of the apparatus may be attached together by peeling away one of the carrier strips at one end 610 of the apparatus and inserting the at least one of the opposed carrier strip ends 612 adjacent the exposed adhesive layer.

However, because the described adhesive article 602 includes an adhesive layer 606, 607 on each side of the flexible substrate 604, it should be appreciated that the adhesive article 602 may be mounted in a different manner than the adhesive article 102 described with respect to FIG. 3. For example in an example 700 shown in FIG. 7, rather than having an upper portion of the adhesive article mounted to a person's clothing while a lower portion is mounted to a napkin, the adhesive article 602 (after being peeled away from each of the carrier strips 608, 609) may be adhesively mounted between a top edge portion of a napkin 302 and the clothing 304 of the person 306 in order to hold the napkin to the clothing of the person.

In an example methodology, the person mounting the adhesive article 602 may place the napkin on a table in a manner that exposes an edge of the napkin. The methodology may further include peeling away one of the carrier strips 608 from the adhesive article 602 and a step of placing the adhesive article (with the exposed adhesive layer 606) onto an upper portion of the napkin adjacent its edge. In this described embodiment, the adhesive article 602 does not need to extend beyond the edge of the napkin.

Figure 7:
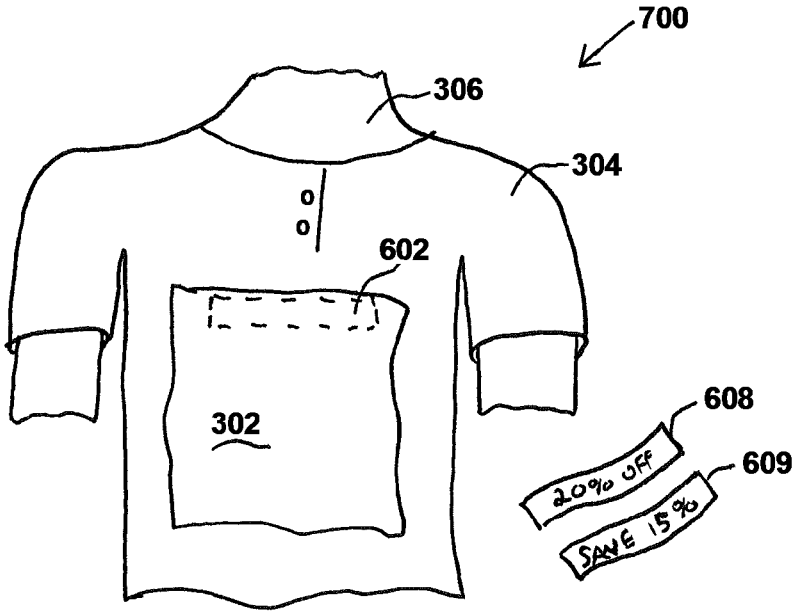
FIG. 7 illustrates an example of a napkin mounted to clothing via a further example adhesive article.

Once the adhesive article has been placed on the napkin, the methodology may include a step of peeling away the second carrier strip 609 to expose the second adhesive layer 607. The methodology may then include moving the napkin and attached adhesive article 602 adjacent to the clothing 304 of the person 306 and pressing the napkin against the clothing, to adhesively bond (using the adhesive layers of the adhesive article) the napkin to the clothing of the person (as shown in FIG. 7).

It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. A method comprising:

a) rolling a napkin into a roll, wherein the napkin is capable of being mounted to a person's clothing using an adhesive article from an apparatus that comprises the adhesive article and at least one carrier strip, wherein the adhesive article includes a flexible substrate with at least one adhesive layer mounted thereto, wherein the apparatus includes the at least one carrier strip mounted to the at least one adhesive layer of the adhesive article, wherein the at least one adhesive layer is operative to remain mounted to the flexible substrate of the adhesive article after the at least one carrier strip is peeled away from the adhesive article, wherein the adhesive article is operative to disintegrate within 30 seconds when submerged in agitated water;

b) curling the apparatus around the roll, wherein the apparatus includes two opposed ends, wherein the at least one carrier strip extends to each of the opposed ends, wherein the adhesive article does not extend to each of the opposed ends;

c) peeling a portion of the adhesive article away from a first portion of the at least one carrier strip adjacent a first end of the apparatus, wherein a portion of the at least one adhesive layer of the adhesive article is exposed; and d) adhesively attaching a further portion of the at least one carrier strip to the exposed portion of the at least one adhesive layer adjacent the first end of the apparatus to form a continuous ring around the roll.

2. The method according to claim 1, wherein in (a) the flexible substrate of the adhesive article includes two adhesive layers on opposed sides of the substrate with which two carrier strips are attached on two opposed sides of the adhesive article, wherein the two adhesive layers are operative to remain mounted to the flexible substrate of the adhesive article after the two carrier strips are peeled away from the adhesive article, wherein the adhesive article, including both the flexible substrate and the two adhesive layers, is operative to disintegrate within 30 seconds when submerged in agitated water, wherein each of the two carrier strips is longer than the adhesive article such that at least portions of at least one end of each of the two carrier strips is not adhesively mounted to the adhesive article, wherein the apparatus corresponds to a first apparatus that is one of at least three apparatuses having a construction corresponding to the first apparatus, further comprising:

e) prior to (a), providing a sheet comprising the at least three apparatuses arranged in side by side arrangement with parallel sets of perforations through the sheet between adjacent pairs of apparatuses, wherein each of the apparatuses is elongated in a longitudinal direction of each apparatus and wherein the perforations extend parallel to the longitudinal directions of the apparatuses, wherein each of the opposed sides of the sheet are comprised of the respectively opposed carrier strips of the at least three apparatuses; and f) prior to (a), tearing the sheet along one of the perforations to separate the first apparatus from the sheet.

3. The method according to claim 2, wherein the napkin is comprised of cloth, further comprising:

g) causing the cloth napkin to be washed in a clothes washing machine, wherein the adhesive article of at least one of the apparatuses is immersed in water in the clothes washing machine, wherein within 30 seconds after the clothes washing machine begins to agitate the water, the adhesive article has disintegrated such that at least one of all and substantially all of the solid residue from the adhesive article remaining in the water is separated into unconnected flakes with a size of less than ¼ of an inch.

4. The method according to claim 2, wherein the adhesive articles of the apparatuses are operative to disintegrate within 30 seconds after being submerged and agitated in water at 70° F., such that at least one of all and substantially all of the solid residue from the adhesive articles remaining in the water is separated into unconnected flakes with a size of less than ¼ of an inch.

5. The method according to claim 2, wherein the two carrier strips of each of the apparatuses include indicia printed thereon.

6. The method according to claim 5, wherein the indicia on at least one of the two carrier strips of each of the apparatuses depicts a coupon that conveys a discount with respect to at least one of an item, a service, or a combination thereof.

7. The method according to claim 6, wherein the indicia on at least one of the two carrier strips of each of the apparatuses depicts textual instructions describing how to use the respective apparatus to mount the napkin to a person's clothing.

* * * * *